United States Patent [19]

Montaner et al.

[11] Patent Number: 4,941,595

[45] Date of Patent: Jul. 17, 1990

[54] SPRAY PUMP

[75] Inventors: Pedro P. Montaner; Victor R. Turró, both of Barcelona, Spain

[73] Assignee: Monturas A.S., Barcelona, Spain

[21] Appl. No.: 393,874

[22] Filed: Aug. 14, 1989

[30] Foreign Application Priority Data

Oct. 10, 1988 [ES] Spain ..... 8803075

[51] Int. Cl.[5] ..... B05B 11/02

[52] U.S. Cl. ..... 222/321; 222/385; 239/333

[58] Field of Search ..... 239/333; 222/321, 340, 222/341, 383, 385

[56] References Cited

U.S. PATENT DOCUMENTS

| | | | |
|---|---|---|---|
| Re.28,366 | 3/1975 | Pechstein | 222/321 X |
| 3,627,206 | 12/1971 | Boris | 222/321 X |
| 4,025,046 | 5/1977 | Boris | 222/321 X |
| 4,082,222 | 4/1978 | Boris | 222/321 X |
| 4,183,449 | 1/1980 | Blake | 222/321 |
| 4,189,064 | 2/1980 | O'Neill et al. | 222/321 |
| 4,305,530 | 12/1981 | Nozawa | 222/321 |

FOREIGN PATENT DOCUMENTS

| | | | |
|---|---|---|---|
| 2051969 | 1/1981 | United Kingdom | 222/321 |

*Primary Examiner*—Kevin F. Shaver

*Attorney, Agent, or Firm*—Staas and Halsey

[57] ABSTRACT

A spray pump comprising a main cylinder and a secondary cylinder with a main piston and a secondary piston, first and second springs are provided for urging the pistons to particular positions. A fixed attachment between the main piston and the secondary cylinder and the latter forms a space with a closed bottom and an open upper end through which the interior of the main cylinder and the secondary cylinder are in communication.

4 Claims, 2 Drawing Sheets

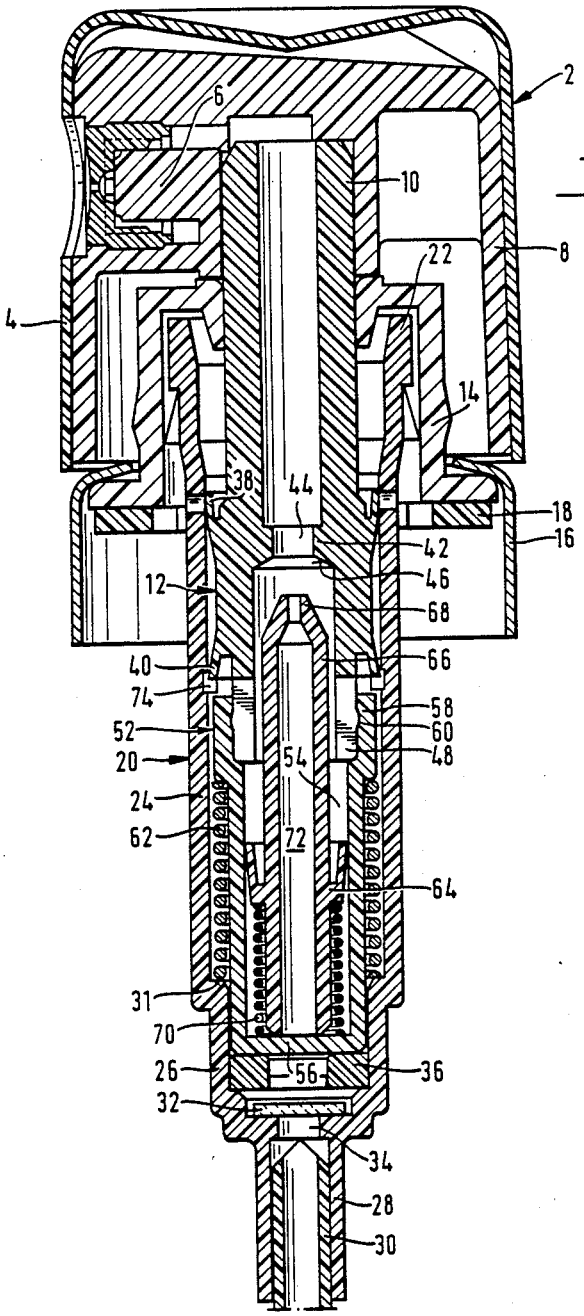
Fig. 2
Fig. 3
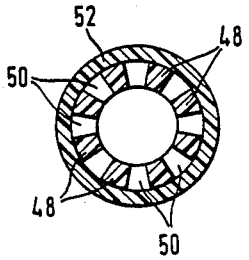
Fig. 4
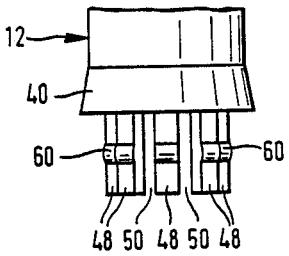

SPRAY PUMP

BACKGROUND OF THE INVENTION

1. Field of the Invention

The invention relates to a spray pump of the type comprising: a main cylinder in which there is defined a pumping chamber; a main piston mounted to slide in said main cylinder between a first inactive position and a second end-of-stroke position, said piston being extended by a hollow rod and having a valve seat therein; first spring means urging said piston to said first position; a secondary cylinder comprised within the main cylinder; a secondary piston mounted to slide within said secondary cylinder between a first closed position and a second open position, said piston being provided with an upper extension having an end applicable against said valve seat; and second spring means urging said secondary piston to said first position thereof.

2. Description of the Prior Art

Frequently in ordinary daily life, it is necessary to spray liquids of quite diverse viscosities towards certain surfaces or spaces. This need is observed, for example, during personal toilet operations to spray lotions, scented waters, deodorants or other products on the human body; and also for domestic cleaning, as also for spraying insecticides, air fresheners, etc.

On such occasions, a strong spray is required, without the intensity thereof being weak at the start or end of the spraying operation since, in this case, the spray is preceded and/or followed by a weak jet which does not attain the desired objective and, therefore, is wasted or even may produce undesired effects, such as stains, drips, etc.

Pumps producing a precompression of the product to be dispensed are already know and the result of said precompression is to allow the vigorous spray mentioned above.

Some of the known pumps are provided with a single spring or resilient means fulfilling two missions, i.e. of causing the piston to recover the starting position thereof after the pump has been operated and of providing the desired precompression; these pumps, therefore, have the drawback of not allowing the recovery speed or conditions and the degree of precompression to be adjusted separately.

The operation of another type of known pumps, as indicated at the beginning, is based on a predetermined ratio between the force of the two spring means provided, such that one of the springs may not be altered unilaterally, without substantially altering the operation of the pump or even preventing it from working.

Since is not possible to change the corresponding resilient means or springs freely or independently in the known, pumps, their field of application becomes, therefore, limited, obliging the manufacture of different pumps for different applications, thereby preventing the manufacture of long runs with the logical effect on costs.

Finally, a third group of pumps having independently replaceable springs may be cited. Nevertheless, these other known pumps suffer various drawbacks, such as a premature, albeit limited communication of the pumping chamber with the outside.

SUMMARY OF THE INVENTION

It is an object of the invention to provide a pump in which the said drawbacks are overcome, while retaining at all times the advantages derived from the precompression of the product to be dispensed.

The above object is attained by a pump of the type mentioned at the beginning, characterised in that there is a fixed connection between said main piston and said secondary cylinder, forming a space having closed bottom and an open upper end through which the pumping chamber and the space are in communication.

BRIEF DESCRIPTION OF THE DRAWINGS

Further advantages and features of the invention will be appreciated from the following description in which there is described without any limiting nature, a preferred embodiment of the invention, to be read with reference to the enclosed drawings, in which:

FIG. 2 is a similar sectional view to the previous one, showing the end-of-stroke position of the main piston.

FIG. 3 is a cross sectional view of the widened portion of the upper open end of the secondary cylinder and of the portion of the axial extension of the main piston.

FIG. 4 is an elevation view of the lower portion of the main piston with the axial extension thereof.

DETAILED DESCRIPTION OF THE INVENTION

Figure 1:
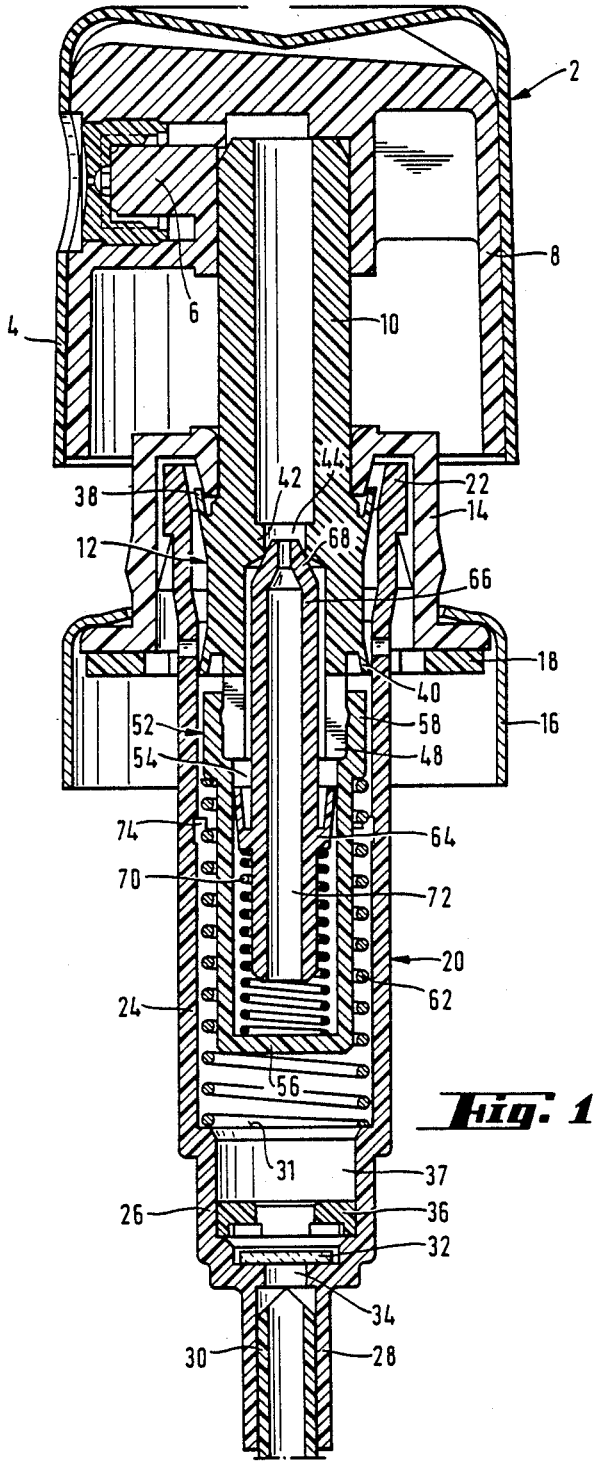
FIG. 1 is an axial sectional view of a spray pump showing the inactive position of the main piston.

The pump of the invention comprises spray and actuating means 2 which are not described in detail because they are conventional and are not necessary for an understanding of the invention. Said means 2 includes a cap 4, a spray member 6 and means 8 for coupling the assembly to the rest of the pump, particularly to the rod 10 of the main piston 12, to be referred to hereinafter.

A body 14 and a cap 16 allow the pump to be connected to the container, not shown, of the material to be sprayed. A seal 18 of appropriate material seals the joint.

Held by said body 14 there is a shell 20, formed by an upper wide portion 22, by a main cylinder 24 having a lower narrower portion 26 and by a portion 28 for attachment to a dip tube 30, shown in part, and which places the pump in communication with the bottom of the said container. There is an annular shoulder 31 between the cylinder 24 and portion 26.

In the lower portion 26 there is a stopper member which in the example shown in a moving disc 32 adapted to close an orifice 34. A perforated cover 36 restricts the movbility of the disc 32, so that it is in a position to fulfil the stopping mission when required.

The cylinder 24 and part of the lower portion 26 define a pumping chamber 37 and the main piston 12 slides along the cylinder 24. The piston is provided with an upper flap 38 and a lower flap 40 bearing against the inner surface of the cylinder 24. The piston 12 is generally tubular and is provided with a transverse wall 42 provided with an orifice 44 having a valve seat 46 formed at the lower end thereof. As stated above, the main piston 12 is extended at the upper end thereof with the hollow rod 10 which places the spray means 6 in communication with the pumping chamber and said main piston may slide between an inactive position (FIG. 1) and an end-of-stroke position (FIG. 2) to be referred to hereinafter.

The main piston 12 is provided with a longitudinal extension 48 extending downwardly from said piston, and said extension 48 is provided with openings 50, the purpose of which will be described hereinafter. In the embodiment shown, said longitudinal extension is seen to be formed by longitudinal strips completely separated from one another by the corresponding openings 50; nevertheless, the invention includes other embodiments not shown which fulfil the purpose which, as said, is described hereinafter.

The pump is also provided with a secondary cylinder 52 which is comprised inside the main cylinder 24. The secondary cylinder 52 forms a space 54 which has a closed bottom end 56 and an open upper end, preferably defined by a widened portion or bowl 58 of the secondary cylinder 52.

The said widened portion 58 snugly surrounds an end portion of the longitudinal extension 48, whereby there is a fixed attachament between the main piston 12 and the secondary cylinder 52, whereby the movement of the piston 12 implies movement of the cylinder 52 and vice versa. To facilitate said fixed attachment, there contemplated first annular means within the widened portion 58 mating with second external annular means 60 on the longitudinal extension 48, both being mutually engageable.

It is to be noted that the attachment between these two members does not close all the apertures 50, but the part of the apertures 50 closest to the lower flap 40 remain open. Consequently there is a communication between the pumping chamber 37 and said space 54. The embodiment shown is simply an example, since the invention contemplates any other type of fixed attachment between the piston 12 and the secondary cylinder 52 which at the same time ensures the communication between the pumping chamber 37 and the space 54.

First spring means 62, preferably a coil spring, urge the main piston 12 to the first inactive position thereof.

In the embodiment shown, the coil spring extends between the annular shoulder 31 and the start of the widened portion 58 of the secondary cylinder.

There is also provided a secondary piston 64 adapted to slide in the said secondary cylinder 52, between a first closed position and a second open position. The secondary piston 64 is provided with an upper extension 66 having a free end 68 which may bear against the valve seat 46, in which case it stoppers the orifice 44. Second spring means 70 urge the secondary piston to the first closed position thereof. To this end said means bears against the bottom 56 and the secondary piston itself.

The secondary piston 64 may be solid, although it is preferably hollow, having therefore an axial cavity 72. This configuration allows the air to be removed from the secondary cylinder 52 during the assembly of the pump. Furthermore, when the secondary piston is slightly defective, part of the liquid to be sprayed penetrates to the bottom of the secondary cylinder and the liquid is expelled through the cavity 72 while the pump is operating. Obviously this explusion could not take place if the piston were solid.

The main cylinder 24 is provided in the interior thereof with small cells 74 which are engaged by the lower flap 40 the main piston 12 when it reaches the second position thereof. In this way a circuit is formed for expelling the air when priming the pump. Other orifices and passages are to be found in the pump to make the circulation of air towards the interior of the container possible, so as to replace the volume of liquid removed in each case. Nevertheless, such members are not described as not being directly associated with the invention.

The pump operates as follows. Once it has been primed, the means 2 are actuated, whereby a downwardly directed force is applied to the main piston 12 resulting in the formation of pressure in the liquid occupying the chamber 37, obviously without the liquid being compressed. Since the chamber 37 is in communication with the space 54, the pressure created is applied to the secondary piston 64. When this pressure is sufficient to overcome the force of the second spring means 70, said secondary piston 64 descends and, therefore the end 68 of the extension 66 moves away from the valve seat 46. This opens up and exit path for the liquid to the outside and said exit is maintained whilever the operating force is applied to the means 2 and until the bottom 56 of the secondary cylinder 52 abuts the the perforated cover 36. It should be observed that during this stage, the pressure created in the liquid holds the disc 32 closing the orifice 34, whereby the liquid may not flow back to the container. Furthermore, it should also be noted that when the passage is opened to the liquid to the outside, liquid is already precompressed, whereby the liquid exits with force and without weak drippings being caused. Such drops do not occur at the end either, since when the liquid pressure tends to diminish, the force of the second spring means 70 prevails and the pump is rapidly closed again.

When the pump actuating means are released (apart from closing the orifice 44), the first spring means 62 recover, whereby the main piston 12 rises, causing a depression which separates the cover 32 from the orifice 34 and the liquid in the container fills the pumping chamber 37 again, so as to be able to start a new liquid spray operation cycle.

The aforedescribed pump is also provided with a special peculiarity residing in the fact that the two spring means 62 and 70 are completely independent. In fact, the actuation of the first spring means 62 depends only on the force applied to the means 2, without the greater or lesser strength of the second spring means 70 having any influence. Therefore, the first spring means 62 may be selected in each case depending on the greater or lesser viscosity of the liquid (possibly a paste) and bearing in mind also the friction within the pump. Furthermore, the desire to have a "hard" or a "soft" pump may be satisfied.

For the same reasons, the second spring means 70 may be selected in each case depending on the higher or lower degree of precompression desired for the pump.

Therefore, the pump of the invention is suitable for a wide range of liquid viscosities and also for a wide range of precompression values, the only thing being required in each case is to fit the appropriate springs. It is obvious that this peculiarity allows a large number of like pumps to be manufactured (the springs varying according to the end purpose of the pumps), with the consequent cheapening of costs.

Finally, it is pointed out that the pump of the invention maintains the communication of the bottom of the secondary piston with the atmosphere always, provided that the secondary pump 64 is hollow.

What we claim is:

1. A spray pump of the type comprising: a main cylinder in which there is defined a pumping chamber; a main piston mounted to slide in said main cylinder between a first inactive position and a second end-of-stroke position, said piston being extended by a hollow rod and having a valve seat therein; first spring means urging said piston to said first position; a secondary cylinder comprised within the main cylinder and having a closed bottom and an open upper end; a secondary piston provided with an upper extension having an end in contact with said valve seat; said secondary piston being mounted to slide within said secondary cylinder between a first closed position in which the end contacts the valve seat and a second open position, in which the end is not in contact with said valve seat; and a second spring means urging said secondary piston to said first position therefore, characterised in that there is a fixed connection between said main piston and said secondary cylinder, forming a space therebetween through which the pumping chamber and said secondary cylinder are in communication.

2. The pump of claim 1, wherein said fixed connection is provided by a widened portion of said secondary cylinder positioned in said upper open end, side widened portion surrounding an end portion of a longitudinal extension of said main piston, there being provided openings in said longitudinal extension.

3. The pump of claim 2, wherein said widened portion of said secondary cylinder is provided internally with a first annular portion, complementing a second external annular portion of said longitudinal extension, said first and second portions being mutually engageable.

4. The pump of claim 1, wherein said secondary piston is provided with an axial cavity extending along its whole length.

* * * * *

UNITED STATES PATENT AND TRADEMARK OFFICE

CERTIFICATE OF CORRECTION

PATENT NO. : 4,941,595

DATED : July 17, 1990

INVENTOR(S) : Pedro P. Montaner and Victor R. Turro

It is certified that error appears in the above-identified patent and that said Letters Patent is hereby corrected as shown below:

FRONT PAGE [73] Assignee: "Monturas A.S." should be --Monturas S.A.--.

Signed and Sealed this

Tenth Day of March, 1992

*Attest:*

HARRY F. MANBECK, JR.

*Attesting Officer*

*Commissioner of Patents and Trademarks*